US006305071B1

(12) United States Patent
Van Zeeland

(10) Patent No.: US 6,305,071 B1
(45) Date of Patent: Oct. 23, 2001

(54) METHOD FOR CONVERTING A FLAT PANEL SWITCH

(75) Inventor: Anthony J. Van Zeeland, Mesa, AZ (US)

(73) Assignee: Duraswitch Industries, Inc., Mesa, AZ (US)

( * ) Notice: Subject to any disclaimer, the term of this patent is extended or adjusted under 35 U.S.C. 154(b) by 0 days.

(21) Appl. No.: 09/539,110

(22) Filed: Mar. 30, 2000

(51) Int. Cl.[7] ..... H01F 41/00
(52) U.S. Cl. ..... 29/602.1; 29/401.1; 29/622
(58) Field of Search ..... 335/205, 207; 29/602.1, 622, 401.1

(56) References Cited

U.S. PATENT DOCUMENTS 4,303,811 12/1981 Parkinson .

5,666,096 * 9/1997 Van Zeeland .

* cited by examiner

*Primary Examiner*—Carl E. Hall
(74) *Attorney, Agent, or Firm*—Cook, Alex, McFarron, Manzo, Cummings & Mehler, Ltd.

(57) ABSTRACT

This concerns a method and kit for converting a flat panel switch to a raised panel switch by mounting a rotary switch thereto. The flat panel switch has a carrier layer. A set of electrodes forming an electrical circuit is disposed on the carrier. The kit includes a rotor having a head mounted in a front cover. A stem attached to the head extends through the front cover for actuation by a user. An electrical contact member is connected to the head for movement therewith. The contact member is associated with the electrodes to alter the condition of the electrical circuit upon actuation of the rotor. The front cover has latches that extend through perforations in the carrier for engagement with a back cover. The latches lock the front and back cover in place on the carrier.

11 Claims, 2 Drawing Sheets

METHOD FOR CONVERTING A FLAT PANEL SWITCH

BACKGROUND OF THE INVENTION

Membrane switches are well known for providing electrical switching functions in a reliable, compact package. Membrane switches typically have a flexible plastic membrane layer normally separated from a substrate by a non-conductive spacer. Openings in the spacer permit a user to push the membrane through the spacer, bringing facing electrical contacts on the internal surfaces of the membrane and substrate into contact with one another, thereby closing a switch. The natural resilience of the membrane returns the membrane to its spaced position upon removal of the actuating force.

While this basic membrane switch construction has many advantages, it does not provide some features desirable in certain applications. For example, in some instances switch users are so accustomed to manipulating a particular type of mechanical actuator that they become confused by a membrane switch. The membrane switch is often a flat panel with graphical elements indicating where to press but having no protruding actuating member. Although membrane switches provide perfectly adequate electrical switching, manufacturers have found that users expecting to find a rotary switch or a slide switch or a push button switch for a certain function are resistant to having the familiar mechanical actuator replaced with a flat panel membrane switch. This is especially true with consumer products. Also, in automotive applications it can be important to provide a rotary or slide switch that a driver can find and manipulate with one hand while not diverting his or her attention from the road. Another difficulty with membrane switches is they are not readily adapted for use as a potentiometer such as might be desirable for, say, a volume control on a radio or CD player.

Rotary and slide switches suitable for use with flat panel switches such as membrane switches are known. Examples are shown in U.S. Pat. Nos. 5,523,730, 5,666,096, and 5,867,082. One of the problems in the past has been the inability to conveniently apply such switches directly to film-based switch panels. The present invention addresses this issue.

SUMMARY OF THE INVENTION

This invention is a method and kit for converting a flat panel switch to a switch panel having discrete components thereon. Such a panel will be referred to herein as a raised panel switch. The method involves preparing a rotary switch mounting kit and applying it to a film-based flat panel switch. The flat panel switch has a carrier sheet with a set of conductors thereon forming an electrical circuit, e.g., spaced contact pads or a potentiometer, both with associated leads. The kit includes a front and a back cover which have cooperating latch members for holding the covers together on opposite sides of the carrier sheet of a flat panel switch. The latch members extend through perforations in the carrier. The front cover latches have hooks that engage notches in the back cover to clamp the pieces together on the carrier. The front cover rotatably mounts a rotor. The rotor has a head inside the front cover and a stem fixed to the head. The stem extends to the outside of the front cover where it mounts a knob which is manipulable by a user. The rotor head carries an electrically conductive contact member. The contact member is engageable with the electrical conductors to alter the state of the electrical circuit when the rotor is actuated. The contact member can be either a conductive wiper attached directly to the rotor head or a magnetically-retained armature that follows magnets mounted in the rotor. If desired a detent mechanism can be incorporated in the front cover and rotor. The carrier may be a single layer or it be one of several layers such as a flexible membrane, substrate and spacer having conventional membrane switches therein in addition to the rotary switch supplied by the kit of the present invention. Alternately, magnetically-actuated push button switches of the type described in the above patents may be incorporated in the carrier.

DETAILED DESCRIPTION OF THE INVENTION

Figure 1:
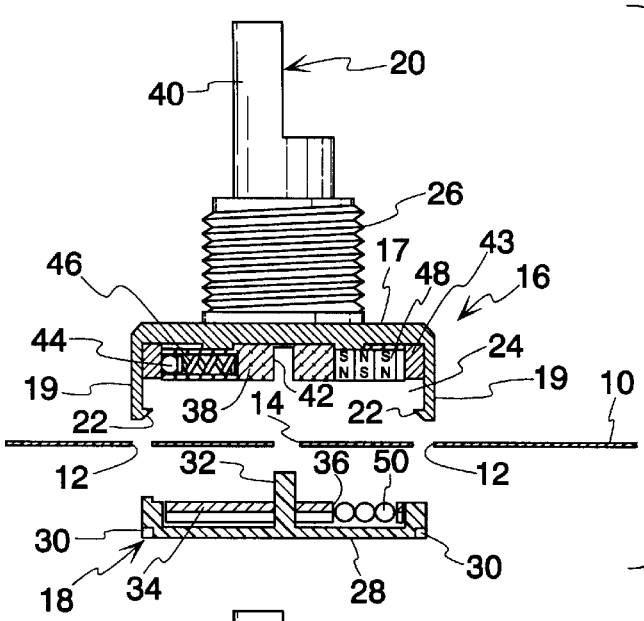
FIG. 1 is an exploded, diagrammatic section of a rotary switch kit used to convert a flat panel switch to a raised panel switch according to the present invention.
Figure 2:
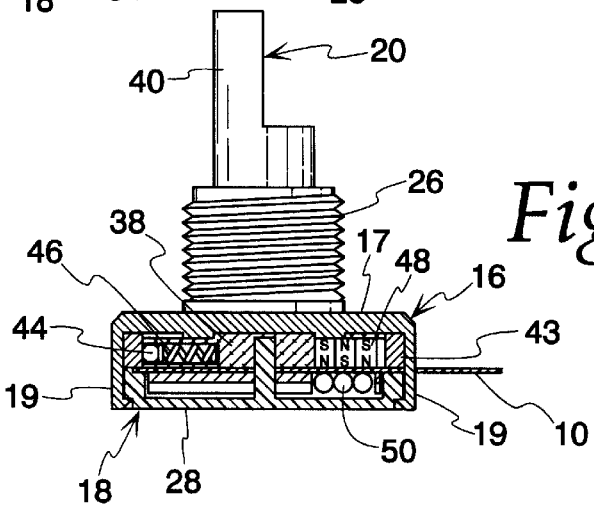
FIG. 2 is a section of the kit of FIG. 1 after assembly.

FIGS. 1 and 2 illustrate the rotary switch kit of the present invention. The kit permits conversion of a flat panel switch to a raised panel switch by means of application of a rotary switch anywhere on a flat panel switch. The flat panel switch comprises a carrier sheet 10 having first and second surfaces and a set of electrical conductors formed on one of those surfaces. The carrier sheet may be made of any material suitable for forming sheets, such as polyester, printed circuit board material or plastic-coated sheet metal. The carrier may be either rigid or flexible as the application requires. In this embodiment the electrical conductors, although not shown, would be formed on the bottom or lower surface of the carrier. The set of conductors would include suitable leads extending to an edge of the carrier or a tail extending therefrom for connection to external electronics. The carrier sheet 10 has perforations 12 through its entire thickness for accepting latch members as will be described. There is also an opening 14 for a locating pin. While the carrier sheet is shown in FIG. 1 in its most basic form, it will be understood that the carrier sheet could incorporate additional features such as conventional membrane switches, magnetically-actuated switches, slide switches and the like. Indeed, one of the benefits of the present invention is its ability to add rotary switches anywhere desired on a flat panel having these other types of devices.

The kit itself comprises three main components, a front cover 16, a back cover 18 and a rotor 20. The front and back covers are held in place on opposite sides of the carrier sheet by a latching connection between them. The rotor is mounted for rotation in the front cover. Details of each main component will now be described.

The front cover 16 has a rectangular or round enclosure 17 which is open on one side toward the carrier sheet. The enclosure 17 includes depending latch members 19 which terminate at hooks 22. The underside of the enclosure defines a rotor cavity 24. There is an opening (not shown) through the center of the enclosure. The exterior of the enclosure may have a threaded bushing 26 attached to it for the purpose of mounting the entire switch, carrier and all, in an instrument panel, circuit board or other apparatus with which the switch is used. The bushing would fit through a hole in the instrument panel and a nut would secure the front cover in place.

The back cover 18 has a housing 28 which may be but is not necessarily similar in shape to the enclosure 17. The housing 28 has notches 30 sized and located to receive the hooks 22 in a snap fit therein. In this embodiment the notches are in the exterior surface of the back cover and face outwardly to receive the hooks which are arranged to fit around the external perimeter of the housing 28. It will be understood that slots in the interior portions of the housing could be used to receive the latch members and hooks. What is important is that the latches engage the back cover so the two covers are locked together on opposite sides of the carrier to hold the covers in place.

Similar to the enclosure 17, the housing 28 has a shape that defines an internal space or chamber adjacent to the carrier. In the center of this chamber there is a locating pin 32. When the back cover is installed on the carrier the pin 32 fits through the opening 14 in the carrier. A ball retainer 34 is mounted within the chamber for rotation about the locating pin 32. The ball retainer has a pocket 36 for receiving a ball armature set as described below. Further details of a ball retainer are described in U.S. patent application Ser. No. 09/480,606, filed on Jan. 10, 2000 and assigned to the present assignee. The disclosure of this application is incorporated herein by reference.

The rotor 20 has a head 38 and a stem 40. The head is disposed in the cavity 24 of the front cover's enclosure 17. The stem extends through the opening in the enclosure and through the bushing 26. The head and stem are sized so as to be rotatable in the front cover. The upper surface of the head may have a slightly upraised boss engageable with a depression or seat in the underside of the enclosure 17 to center the rotor and fix its position in the front cover. A knob (not shown) may be attached to the stem to facilitate manipulation of the stem by a user. A socket 42 in the head 38 receives the locating pin 32 to further fix the relationship among the front cover, back cover and rotor.

A detent mechanism may optionally be included in the rotor and front cover. In this embodiment the detent mechanism includes a detent ring 43 fastened to the enclosure 17. The internal diameter of the detent ring has a series of grooves or indentations (not shown) that receive a detent ball to define a fixed position of the rotor. A detent ball 44 and spring 46 are located in a radial bore in the head 38. The spring urges the ball into contact with the detent ring's grooves.

An electrical contact member is associated with the rotor. In this embodiment the contact member comprises a coupler 48 and an armature 50. The armature shown comprises three conductive balls held in the ball retainer pocket 36. The coupler is a set of magnets pressed into a receptacle in the rotor head 38. The magnetic attraction of the balls to the magnets causes them to follow the rotor head as it rotates. The balls thus move relative to the electrical contacts on the underside of the carrier. This movement alters the status of the electrical circuit, either by shorting or opening a set of spaced contact pads or by changing the setting on a potentiometer.

Figure 3:
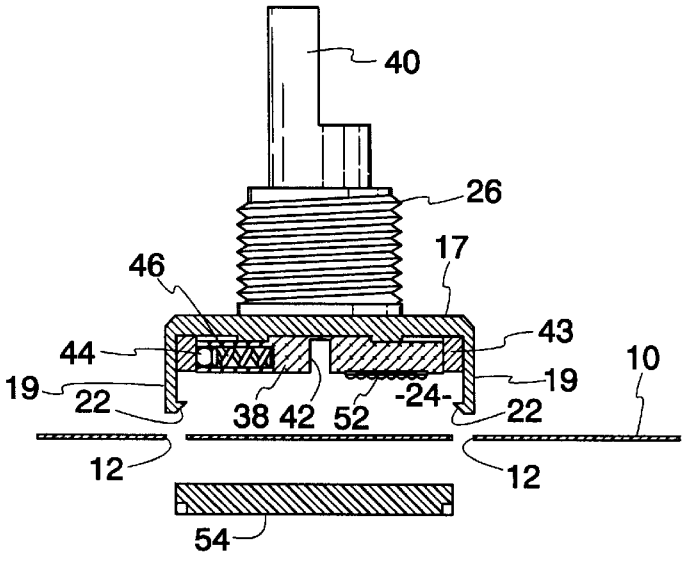
FIG. 3 is a view similar to FIG. 1 showing an alternate form of the electrical contact member.

FIG. 3 illustrates a second embodiment that is similar in many respects to the first embodiment. The primary difference is the electrical contact member in this embodiment is a wiper 52 instead of a coupler and armature. The wiper 52 is preferably a metallic element fastened directly to the underside of the rotor head. It will be understood that with this form of contact member the electrical conductors would be formed on the top of the carrier instead of on the bottom. Otherwise the wiper performs the similar function of moving with the rotor to alter the condition of a potentiometer or to short or open spaced contact pads. The back cover 54 in this embodiment also differs somewhat in that it does not require a chamber for the armature so it may have more or less a simple block configuration with appropriate slots for receiving the front cover latches.

Figure 4A:
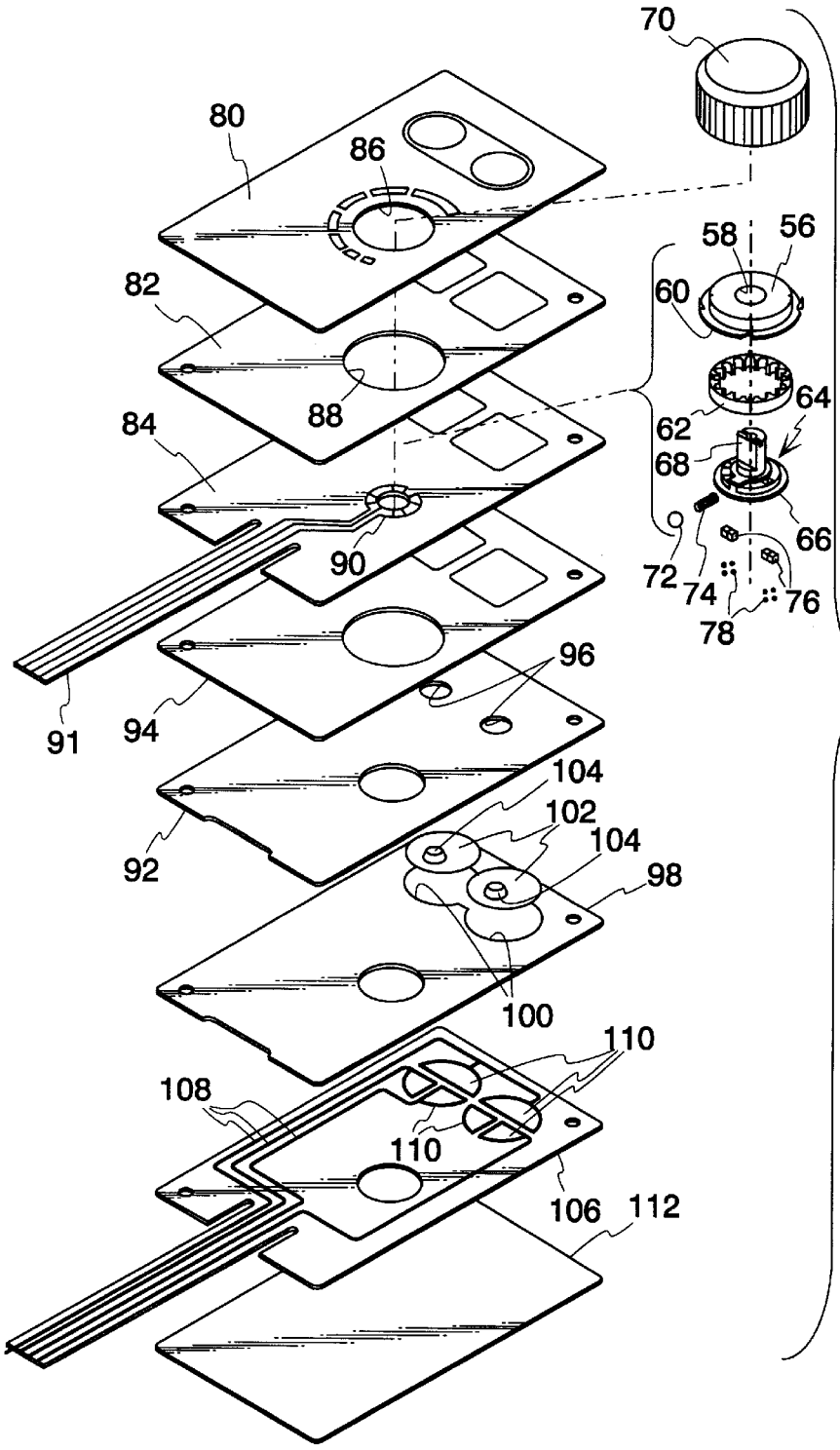
FIG. 4*a* is an exploded perspective view of a further alternate embodiment, showing the kit applied to a flat panel switch with magnetically-actuated push button switches.
Figure 4B:
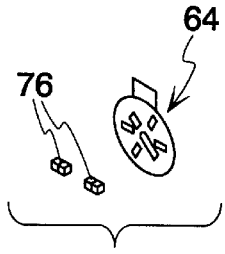
FIG. 4*b* is an enlarged perspective view of the bottom of the rotor.
Figure 4C:
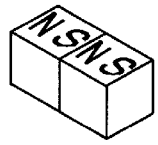
FIG. 4*c* is a further enlarged perspective view of the coupler magnets used in the switch of FIG. 1*a*.

Turning now to FIGS. 4*a*, 4*b* and 4*c*, application of the kit of the present invention to a more complex carrier is shown. The kit in this case includes a front cover 56 having a central opening 58 and a peripheral flange 60. A detent ring 62 fits into the cavity of the front cover. A rotor 64 with a head 66 and stem 68 fit into the front cover. The stem 68 extends through opening 58. A knob 70 fastens to the outer end of the stem. A detent ball 72 and spring 74 fit in a bore in the head 66. Two sets of coupler magnets 76 also reside in the head. Armature balls 78 follow the magnets around on the opposite side of a sheet of plastic as described below.

These components are mounted on a three-part carrier comprising, from top to bottom, an overlay 80, an upper spacer 82 and an upper circuit sheet 84. These three layers are adhesively bonded together. The overlay has an aperture 86 directly above an opening 88 in the upper spacer. The aperture 86 is sized to permit all but the flange 60 of the front cover to fit therethrough. The flange 60 resides in the spacer opening 88. The underside of the upper circuit sheet 84 has a set of electrical conductors 90 printed thereon. As FIG. 4*a* shows these conductors extend onto a tail portion 91 for external connection. The armature balls 78 roll on the underside of the upper circuit sheet 84, in association with the conductors 90.

The switch panel of FIG. 4*a* further comprises a magnet layer 92 bonded by adhesive 94 to the three-part carrier. The magnet layer has ports 96 therein and overlies a lower spacer 98. Apertures 100 in the lower spacer accommodate push button armatures 102 which are made of magnetic material. As used herein "magnetic material" means material that is affected by a magnet. These armatures have buttons 104 which extend into the ports 96 of the magnet layer. Beneath the lower spacer is a lower circuit sheet 106 having electrical conductors 108 formed on its upper surface. These conductors include contact pads 110 which can be shorted by the armatures 102. The armatures are normally held in spaced relation to the pads 110 by the magnetic attraction to the magnet layer 92. When a user depresses the overlay 80 above an armature 102 the force is transferred to the button 104 and causes the armature to snap free of the magnet layer and short the pads. Release of the actuating pressure allows the magnet layer to retract the armature back into spaced relation with the pads. A substrate or backing plate 112 may be adhesively attached to the lower circuit sheet 106.

It can be seen that the rotary switch kit of the present invention permits application of a rotary switch wherever it may be desirable on a flat panel switch. All that is needed is to print or otherwise form the appropriate electrical conductors and punch the perforations in the carrier to allow mounting of the front and back covers. Thus, existing flat panels can have rotary switches added thereto without interfering with the existing construction.

While a preferred form of the invention has been shown and described, it will be realized that alterations and modifications may be made thereto without departing from the scope of the following claims. For example, instead of having latches extend through the carrier to engage a back cover, the rotary switch with the wiper contact could have the front cover adhesively secured to the carrier. In that embodiment no back cover would be necessary.

What is claimed is:

1. A method of converting a flat panel switch to a raised panel switch, said flat panel switch having a carrier with first and second surfaces, a set of electrical conductors formed on at least one of said surfaces and defining an electrical circuit, comprising the steps of:

attaching a front cover to one of the carrier surfaces, the front cover defining a rotor cavity adjacent said one surface;

mounting a rotor for rotation on the front cover, the rotor including a head in the cavity and a stem connected to the head and extending to the exterior of the front cover where it is actuatable by a user; and associating an electrically conductive contact member with the head for rotary movement therewith, at least a portion of the contact member being engageable with the set of electrical conductors such that movement of the contact member with the rotor head alters the electrical circuit defined by the conductors.

2. The method of claim 1 further comprising steps of forming at least one perforation in the carrier, providing at least one latch extending from the front cover through the perforation, and attaching a back cover to the latch on the other surface of the carrier.

3. The method of claim 1 wherein the electrical conductors are on said one surface of the carrier and the contact member comprises a wiper attached to the head and engageable with the electrical conductors.

4. The method of claim 1 wherein the electrical conductors are on the other surface of the carrier and wherein the step of associating the contact member with the head is characterized by attaching a coupler to the head and placing an armature engageable with the electrical conductors on said other surface of the carrier, one of the coupler and armature being a permanent magnet and the other being made of magnetic material such that the armature is normally held in sliding engagement with said other surface of the carrier by the magnetic attraction between the coupler and armature, movement of the coupler causing corresponding movement of the armature that alters the electrical circuit defined by the conductors.

5. The method of claim 1 wherein the carrier comprises a membrane switch panel of the type having a substrate, a flexible membrane overlying the substrate, a spacer sandwiched between the inner surfaces of the membrane and substrate, and the set of electrical conductors are formed on at least one of the membrane and substrate to define said electrical circuit.

6. The method of claim 5 wherein the spacer has at least one opening therein and the set of electrodes includes contact pads on the side of the substrate facing the spacer and aligned with the spacer opening, and further comprising a magnet layer between the membrane and spacer and a push button armature made of magnetic material and disposed in the spacer opening, normally in spaced relation to the contact pads by the magnetic attraction between the magnet layer and the armature.

7. The method of claim 1 further comprising the step of attaching a knob to the rotor.

8. The method of claim 1 further comprising the step of forming a detent mechanism in one or both of the front cover and rotor.

9. The method of claim 1 wherein the electrical conductors are on the other surface of the carrier and further comprising the steps of forming at least one perforation in the carrier, placing at least one latch from the front cover through the perforation, and attaching a back cover to the latch on the other surface of the carrier; and wherein step of associating the contact member with the head is characterized by attaching a coupler to the head and engaging an armature with electrical conductors on said other surface of the carrier, one of the coupler and armature being a permanent magnet and the other being made of magnetic material such that the armature is normally held in sliding engagement with said other surface of the carrier by the magnetic attraction between the coupler and armature, movement of the coupler causing corresponding movement of the armature that alters the electrical circuit defined by the conductors.

10. The method of claim 9 wherein the back cover defines a chamber for receiving the armature.

11. The method of claim 10 further comprising the step of engaging an armature retainer with the armature in the back cover chamber.

* * * * *